US005144325A

United States Patent [19]

Kurcbart

[11] Patent Number: 5,144,325

[45] Date of Patent: Sep. 1, 1992

[54] DETACHABLE WRIST BAND ANTENNA

[75] Inventor: Robert Kurcbart, Boca Raton, Fla.

[73] Assignee: Motorola, Inc., Schaumburg, Ill.

[21] Appl. No.: 739,577

[22] Filed: Aug. 2, 1991

[51] Int. Cl.[5] ..... H01Q 1/12

[52] U.S. Cl. ..... 343/718; 343/906

[58] Field of Search ..... 343/718, 906

[56] References Cited

U.S. PATENT DOCUMENTS 4,947,179 8/1990 Ganter et al. ..... 343/718

4,977,614 12/1990 Kurcbart ..... 455/193

*Primary Examiner*—John D. Lee

*Assistant Examiner*—Robert E. Wise

*Attorney, Agent, or Firm*—Pablo Meles

[57] ABSTRACT

An apparatus (20) comprises a radio receiver disposed in a housing (22) having two opposed ends, a wrist band (24) having a conductor (40) throughout the length of the wrist band from a first end (26) to a second end (28), and a connector (32, 34, and 36) within the opposed ends of the radio receiver housing and within the first end and second end of the wrist band for detachably coupling the wrist band to the radio receiver housing forming a loop antenna.

19 Claims, 2 Drawing Sheets

DETACHABLE WRIST BAND ANTENNA

TECHNICAL FIELD

This invention relates generally to antennas and, more particularly, to snap-on wrist band antennas.

BACKGROUND

Referring to FIG. 1, there is shown a wristwatch radio 10 having a known antenna system. The antenna system includes a loop antenna 16 mounted on the wrist band and attached to a radio housing 12. This type of wrist band antenna fails to provide ease of assembly and manufacture since the antenna is retained by the housing of the radio 10. Furthermore, if a user needed to replace the antenna, the radio housing would require disassembling. Thus, the present invention provides a wrist band antenna that would be easily detachable and replaceable.

SUMMARY OF THE INVENTION

An detachable loop antenna for use in a wrist band radio comprises a wrist band having two end portions, a connector means within the end portions of the wrist band for detachably electronically coupling the loop antenna to the radio, and a conductive runner coupled to the radio and the connector means within the wrist band forming the loop antenna.

DETAILED DESCRIPTION OF THE PREFERRED EMBODIMENT

Figure 1:
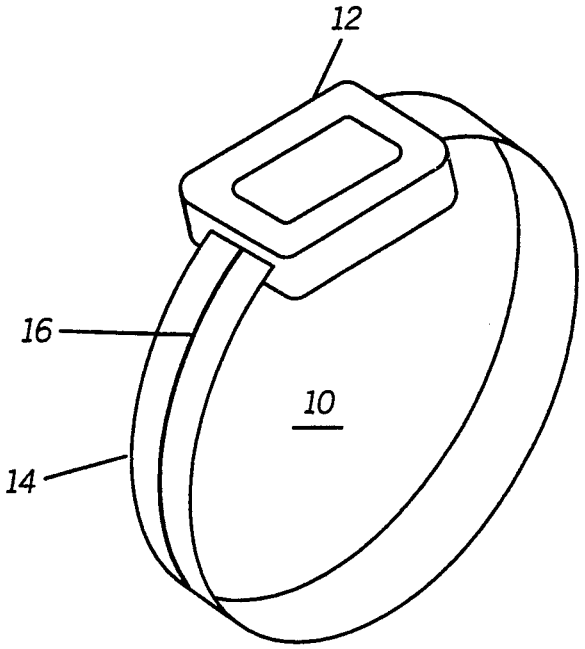
FIG.1 (PRIOR ART)
FIG. 1 is a perspective view of a wrist band pager.
Figure 2:
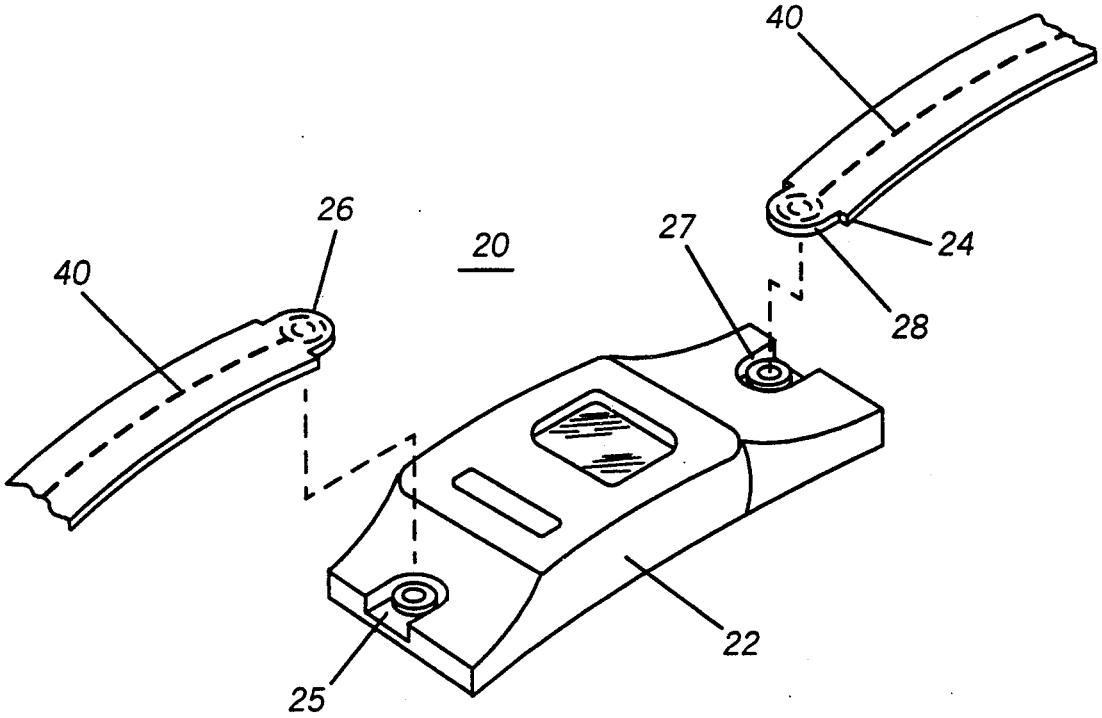
FIG. 2 is a perspective view of a wrist band pager in accordance with the present invention.

Referring to FIG. 2, there is shown an apparatus 20 preferably being a radio, a selective call receiver or pager, or a wrist watch pager within a housing 22. The apparatus 20 further comprises a wrist band 24 having end portions 26 and 28 and a conductor 40 integrally formed therein so as to couple the end portions. The wrist band is preferably made of a flexible material such as plastic commonly used for watch wrist bands. The conductor 40 and end portions 26 and 28 form a portion of a loop antenna. The housing 22 further includes receiving areas 25 and 27 for mounting end portions 26 and 28 respectively to the housing 22. The end portions 26 and 28 and the receiving areas 25 and 27 form a connector means for detachably electronically coupling the wrist band 24 to the housing 22. The connector means preferably comprises snap-on connectors commonly found on wrist static control bands or clothing snaps, but other means for detachably electronically coupling are within contemplation of the present invention.

Figure 3:
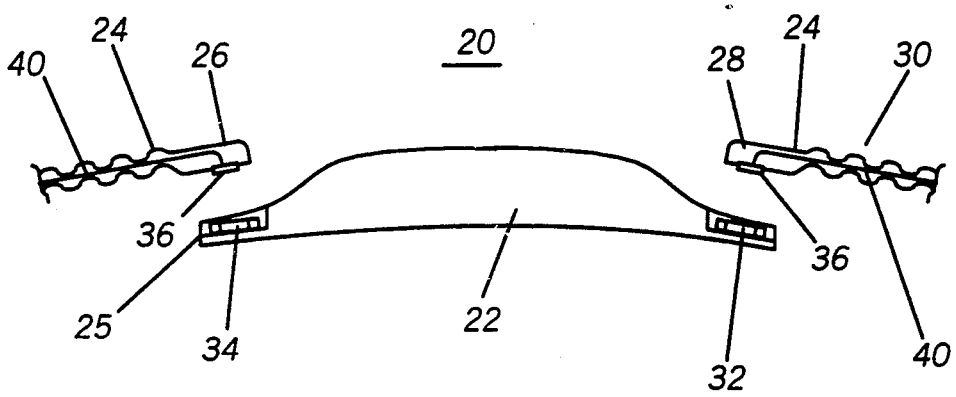
FIG. 3 is a side plan view of the wrist band pager of FIG. 1 in accordance with the present invention.
Figure 4:
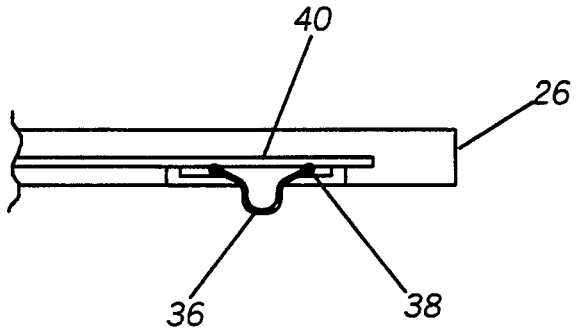
FIG. 4 is an side view portion of the wrist band of FIG. 2.
Figure 5:
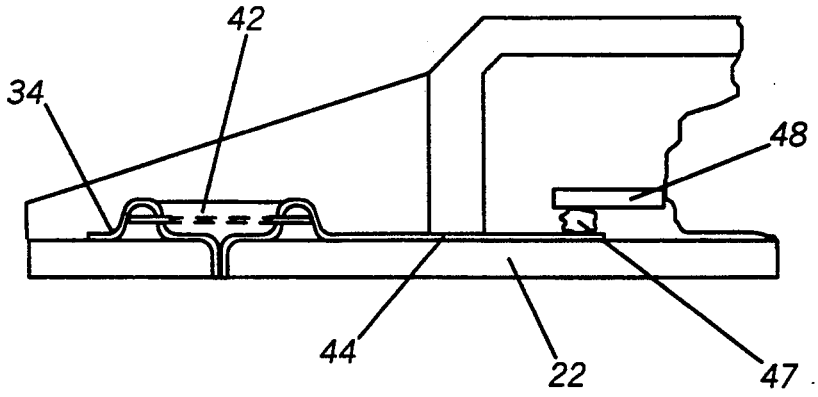
FIG. 5 is a side view portion of the pager of FIG. 2.

Referring to FIG. 3., there is shown a side view of the apparatus 20 including the housing 22 and the wrist band 24. Preferably, each of the end portions 26 and 28 of the wrist band have a male snap-on member 36 for electrically coupling to female members 34 and 32 respectively. Furthermore, the wrist band 24 preferably includes a flexible ribbed area 30 as found in typical sports wristwatch bands to provide stress relief and otherwise prevent unsnapping of the snap-on connectors. Referring to FIGS. 4 and 5, exploded side views of the end portion 26 of the wrist band and of the housing 22 is shown. The conductor 40 is preferably made of metal and spot welded (38) to the male snap-on member 36. The male snap-on member is preferably gold plated to provide a durable and highly conductive contact. The male member 36 snaps into the female member 34 in the area 42 which is also preferably gold plated. The female member 34 is preferably insert molded (44) into the housing having a conductive portion electrically coupled to a printed circuit board 48 via solder or connector 47 within the housing 22. Again, other easily detachable conductive connectors forming a loop antenna with the receiver (or pager, or two-way radio, or wrist watch pager) is within contemplation of the present invention.

What is claimed is:

1. A detachable loop antenna for use in a wrist band radio, comprising:

a wrist band having two end portions;

connector means within the end portions of the wrist band for detachably electronically coupling the loop antenna to the radio, wherein said connector means comprises snap fit connectors; and a conductive runner coupled to the radio via the connector means, wherein the conductive runner lies within the wrist band forming the loop antenna.

2. The detachable loop antenna of claim 1, wherein said connector means comprises snap fit connectors having a male portion on the wrist band and a female portion on the radio.

3. The detachable loop antenna of claim 1, wherein said connector means comprises snap fit connectors having a female portion on the wrist band and a male portion on the radio.

4. The detachable loop antenna of claim 1, wherein said wristband radio comprises a pager.

5. The detachable loop antenna of claim 1, wherein said wristband radio comprises a two-way radio.

6. The detachable loop antenna of claim 1, wherein said wrist band comprises a flexible ribbed portion for stress relief.

7. An apparatus comprising:

a radio receiver disposed in a housing having two opposed ends;

a wrist band having a conductor throughout the length of the wrist band from a first end to a second end; and connector means within the opposed ends of the radio receiver housing and within the first end and second end of the wrist band for detachably coupling the wrist band to the radio receiver housing forming a loop antenna, wherein said connector means comprises snap fit connectors.

8. The apparatus of claim 7, wherein said connector means comprises snap fit connectors having a male portion on the wrist band and a female portion on the radio housing.

9. The apparatus of claim 7, wherein said connector means comprises snap fit connectors having a female portion on the wrist band and a male portion on the radio housing.

10. The apparatus of claim 7, wherein said radio receiver comprises a pager.

11. The apparatus of claim 7, wherein said apparatus further comprises a radio transmitter forming a two-way radio.

12. The apparatus of claim 7, wherein said wrist band comprises a flexible ribbed portion for stress relief.

13. The apparatus of claim 7, wherein said apparatus further comprises a watch forming a wrist watch pager.

14. A selective call receiver, comprising:

receiver means disposed in a housing;

a wrist band having a conductor within the wrist band and spanning from a first end to a second end of the wrist band;

connector means within the housing and within the first and second ends of the wrist band for detachably coupling the wrist band to the receiver means and arranged and constructed to form an antenna, wherein said connector means comprises snap fit connectors.

15. The selective call receiver of claim 14, wherein said connector means comprises snap fit connectors having a male portion on the wrist band and a female portion on the radio housing.

16. The selective call receiver of claim 14, wherein said connector means comprises snap fit connectors having a female portion on the wrist band and a male portion on the radio housing.

17. The selective call receiver of claim 14, wherein said receiver comprises a pager.

18. The selective call receiver of claim 14, wherein said selective call receiver further comprises a radio transmitter forming a two-way radio.

19. The selective call receiver of claim 14, wherein said wrist band comprises a flexible ribbed portion for stress relief.

* * * * *